United States Patent [19]

Fukuyama

[11] 3,970,015

[45] July 20, 1976

[54] AUTOMATIC SEAMING METHOD AND LONG SEAMER THEREFOR

[75] Inventor: Yoshinobu Fukuyama, Kashiwara, Japan

[73] Assignee: Takatori Machinery Works Ltd., Japan

[22] Filed: May 30, 1975

[21] Appl. No.: 582,216

[30] Foreign Application Priority Data

Nov. 8, 1974 Japan ..... 49-129356
Mar. 4, 1975 Japan ..... 50-25565

[52] U.S. Cl. ..... 112/121.12; 112/153
[51] Int. Cl.[2] ..... D05B 21/00
[58] Field of Search ..... 112/121.12, 121.11, 112/121.15, 121.29, 153, 152, 262

[56] References Cited

UNITED STATES PATENTS

| | | | |
|---|---|---|---|
| 1,623,075 | 4/1929 | Thomas | 112/121.12 |
| 3,588,973 | 6/1971 | Forton et al. | 112/153 X |
| 3,774,558 | 11/1973 | Scholl et al. | 112/121.12 |
| 3,921,550 | 11/1975 | Marjorio | 112/121.12 |

*Primary Examiner*—H. Hampton Hunter
*Attorney, Agent, or Firm*—Kenyon & Kenyon

[57] ABSTRACT

A long seamer for seaming garment sections automatically, which comprises a stationary working table, a sewing machine head, a patterning device and an endless flat belt, wherein the travelling passage of said flat belt is defined by a plurality of patterning devices, and a side surface of a flexible guide band is deformed into a cure similar to the curve of the stitching line on said fabrics by said patterning devices, so that the flat belt moves together with the fabrics being stitched by said sewing machine head in such a way that all portions on the stitching line of said garment sections are moved along the same curved passage.

8 Claims, 6 Drawing Figures

AUTOMATIC SEAMING METHOD AND LONG SEAMER THEREFOR

The present invention relates to an automatic long seamer for seaming a garment section, wherein the seamer comprises a stationary working table, a sewing machine head, a patterning device and an endless flat belt.

The term "long seamer" as used herein refers to a machine for seaming a garment section already cut in a shape which has rather long edges to be seamed and, especially, where said edges are of a curved configuration similar to that on many kinds of stitching lines on a garment with long edges, such as trousers and coats.

Several long seamers are already in commercial use. The operation of some of such automatic long seamers consists of the following steps.

Firstly, a garment section is placed on a working table, in such a manner that two long edges of said garment section are placed in contact with a cloth arranging guide pattern provided at one side of said table.

Secondly said fabric is lightly held by means of pattern rail, called a garment holder, on said working table and said pattern rail is moved along a given passage, so that said garment section can be stitched along the stitching line of the garment section by a sewing machine head.

Thirdly, after the above stitching is accomplished, said seamed cloth is freed from the hold of said pattern rail, and then said pattern rail is returned to its initial position quickly.

In the above-mentioned operation, it is necessary to provide a cloth arranging guide plate with a curved surface similar to the curved stitching line. Furthermore, it is necessary to provide a copying attachment in the region near the stitching needle of the sewing machine head. A cloth together with the working table and pattern rail is moved across the position of the sewing machine head in such a manner that the movement corresponds to the curve of the pattern rail. Consequently a curved stitched line is formed on the garment section to be seamed by the sewing needle.

One of the drawbacks of the above described type of long seamer, is that the length of the space occupied by such machine is greater than twice as long as the length of the cloth to be seamed. This is because the pattern rail and cloth must be moved the distance equal to the length of the cloth and then back to its original position. Another drawback is that the same number of cloth arranging guide plates or pattern rails as the number of kinds of stitching lines, must be prepared. Therefore when it is intended to next stitch a curved stitching line different from that of the garment section being seamed, the guide plate and pattern rail must be replaced by another guide plate and pattern rail with a different curve. This replacing operation is a very complicated and costly operation.

The object of the present invention is to provide a long seamer, which eliminates the above-mentioned drawbacks.

To attain the above object, the present invention comprises a stationary working table with a plurality of suction apertures, a sewing machine head arranged at the end of said stationary working plate, an endless flat belt, the travelling passage of which is situated within a horizontal plane, flexible guide band, the curved surface of which is formed by means of a plurarity of patterning devices arranged parallel to the center line of the seamer, a pair of guide rollers mounted on said patterning devices for guiding said endless flat belt in such a way that said guide rollers can be lifted away from the surface of the working table and, also, can be arranged on a curved line by adjusting the projection of the patterning head beyond a vertically displaceable frame provided on the patterning device.

When seaming fabric with long seaming edges by means of the long seamer of the present invention, firstly said flexible guide band is deformed by means of said plurality of patterning devices so that said side surface is curved similar to the stitching line of the garment section to be seamed. The endless flat belt is guided by the corresponding guide rollers along a passage having a similar curve to that of the flexible guide band deformed by means of said patterning devices. When said endless flat belt moves along its curved passage, it moves together with the fabric to be seamed in such a way that all portions on said stitching line of said garment section are moved along the same curved passage. In this case said garment section is deformed partially. Finally a sewing machine head stitches said cloth and the seaming operation for said cloth is completed.

To attain the above seaming method by this long seamer, the present invention is so constructed that the passage of the endless belt can be deformed in a curve similar to the curve of the stitching line to be seamed.

As a pair of rollers are arranged on a patterning head of the patterning device and said rollers hold said belt, when such belt is lowered to the stationary working table so that the cloth can be pressed between said belt and the stationary working table, and if the belt is moved, said belt moves together with said cloth, whereby there is slippage between the cloth and the surface of the working table. As the cloth can be easily deformed in any direction, all portions on the stitching line of said cloth or garment section can be moved along the given curved passage and deformed accordingly.

The passage of the endless belt can be deformed easily by the patterning device of the present invention, and the flexible guide band can be deformed simultaneously. Therefore, this device is so constituted that it is a versatile device, on which several kinds of stitching lines having different curves can be stitched on a garment section.

The seamer occupies only a small space, the length of which is slightly longer than total length of the cloth to be seamed plus the width of the sewing machine head. This means that much less space is required for the present machine than the above-mentioned conventional machine. In addition to this in this seamer only the adjustments for the moving path of the flat belt and the curved surface of the guide patterning band are necessary, and it is unnecessary to replace one member with another, as in the case of the conventional machine.

Further the present device can seam a garment section with curved edge without trouble, because when said garment section is moved by the endless flat belt along the curved passage, it can be easily deformed.

The present invention will be better understood from the following description taken in connection with the accompanying drawings, in which.

Figure 1:
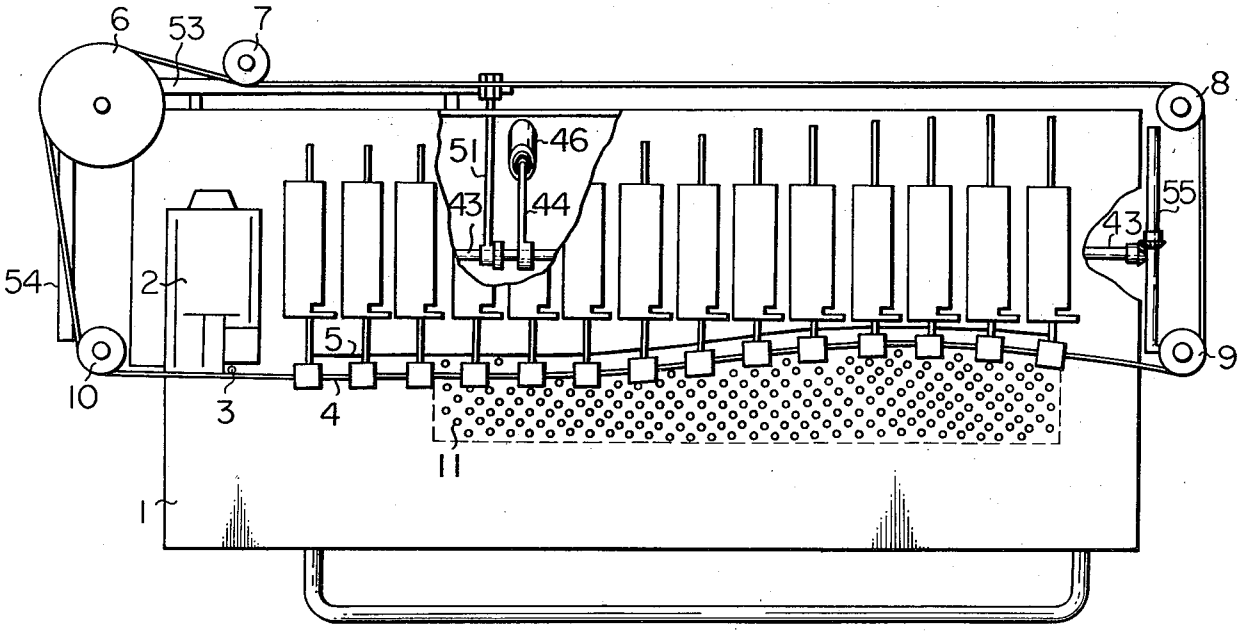
FIG. 1 shows a plane view of the long seamer of the present invention.
Figure 2:
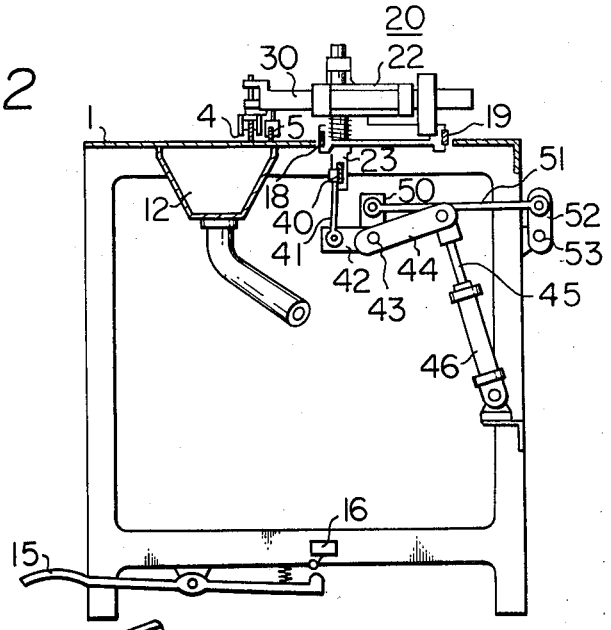
FIG. 2 shows a sectional view of the machine shown in FIG. 1.
Figure 3:
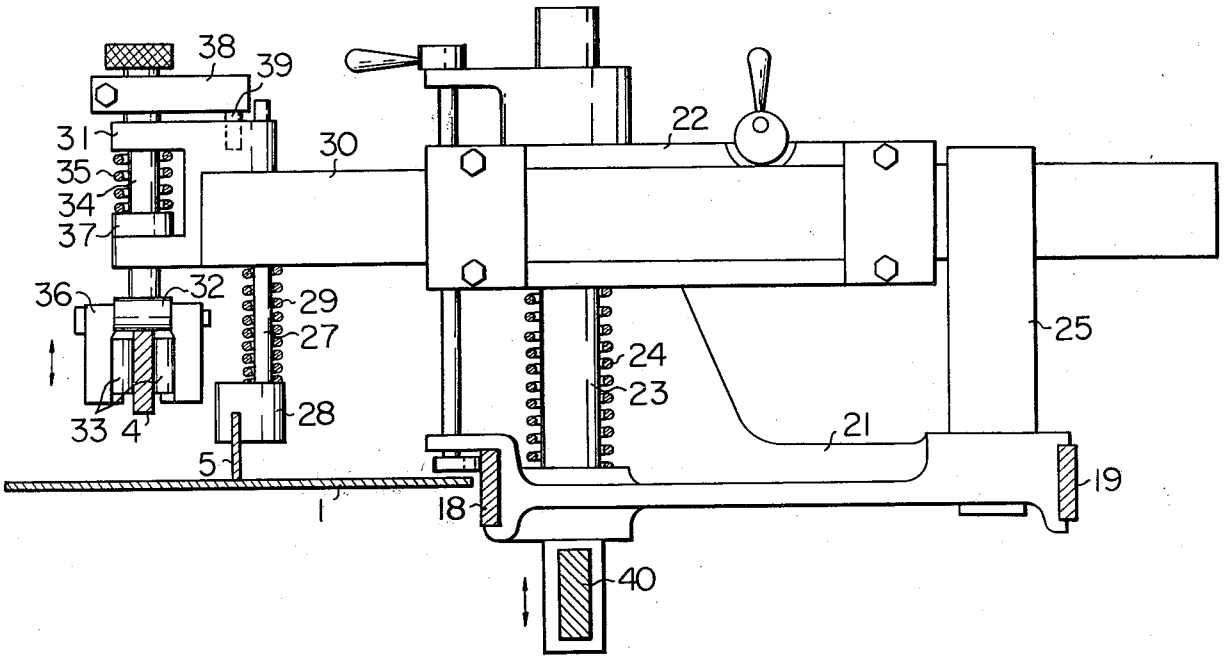
FIG. 3 shows a side view of the pattern device of the present invention.

As shown in FIGS. 1 through 3, the long seamer of the present invention is provided with a stationary working table 1 mounted on a frame of this long seamer. A plurality of suction holes 11 are arranged within an area of the surface of said table 1, and this area is completely covered by the clothes to be seamed when said clothes are initially placed on the surface of said working table 1. Under the area of said suction holes 11, there is a suction duct 12, the bottom end of which is connected to the suction source (not shown).

Figure 4:
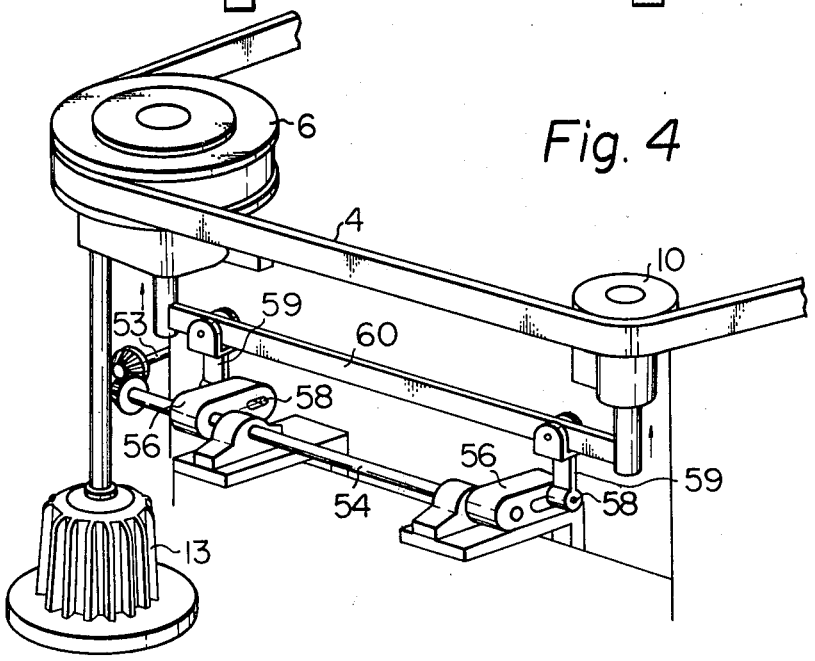
FIG. 4 shows a perspective view of a belt guide or driving pulley, and also a mechanism for lifting the same, of the present invention.

A front guide rail 18 and a back guide rail 19 are mounted longitudinally on said frame of the seamer, and onto said two guide rails, a plurality of frames 21 of patterning devices 20 are adjustably mounted and arranged in parallel with the same space therebetween. Such mounting of said frame 21 to the front and back guide rails 18 and 19, can be done by means of a securing device, such as a device using an eccentric disc. shown in FIG. 4.

A lifting rod 23 is slidably mounted on said frame 21 and passes through vertical holes provided on said frame 21. A square hole is provided on the lower end of said rod 23 so that a lifting bar 40 may pass therethrough. A vertically displaceable frame 22 is rigidly fixed on the upper portion of said lifting rod 23, and said frame 22 is provided with a horizontal guide way for a patterning frame 30, so that the frame 30 can be adjustably mounted on and fixed to the frame 22 by means of a securing device such as a device using an eccentric disc. as shown in FIG. 3.

A spring 24 is arranged between the bottom surface of said vertically displaceable frame 22 and the upper surface of said frame 21, and mounted on the lifting rod 23, so that the spring force of said spring 24 can support the total dead weight of the complete unit of said vertically displaceable frame 22 and said patterning frame 30 together with other members including a patterning head 31. It is preferable that a vertical guide member 25 be provided on the frame, so that the rear part of said patterning frame 30 can be guided vertically by means of a vertically slit provided on said vertical guide member 25.

A sewing machine head 2 is mounted on a frame of the seamer at a region downstream from the last patterning device 20 and also near the end of the working table 1. A patterning head 31 is fixed on the front end of said patterning frame 30. A pair of vertical holes are provided on the upper and lower arms of said head 31, and a vertical slide shaft 34 passing through said vertical holes is mounted on said head 31. On a guide roller frame 36 mounted on a bottom end of said vertical slide shaft 34, a pair of horizontal guide rollers 32 are horizontally arranged so that the bottom of said rollers 32 can guide the top edge of an endless flat belt 4. A pair of vertical guide rollers 33 are also mounted on said guide roller frame 36, in such an arrangement that the width of the space between the two guide rollers 33 is slightly narrower than the width of said endless belt 4. Therefore, both sides of said endless belt 4 can be guided by said rollers 33, and said endless belt 4 can be held by said rollers 33, in such a way that when said belt is lifted by said rollers it will not drop from said rollers. Consequently, when the patterning frame 30 is lifted away from the surface of the working table 1, the lower edge of said endless belt 4 can be separated from the upper surface of said working table 1, so that clothes to be seamed can be inserted into a space between the endless belt and the working table.

For the purpose of safety, a spring 35 is mounted between the upper arm of said patterning head 31 and the collar 37 fixed on said vertical sliding shaft 34. In this arrangement, the bottom surface of said collar 37 can be rested on the upper surface of the lower arm of said head 31, so that said spring can be compressed when the patterning frame 30 is excessively lowered. It is preferable that, the angular displacement of the sliding shaft 34 against the patterning head 31 be adjustable, and be secured by means of a securing device, as shown in FIG. 3, after being angularly displaced, so that said head can follow the curved passage, on which said flat belt must move.

An upright rod 27 mounted on a steel band guiding member 28 is arranged in the vertical hole provided on the patterning frame 30 at the midway point between the patterning head 31 and the lifting rod 23. A vertical slit is provided on the surface of the under side of said steel band guiding member 28, so that into said slit an upper portion of a flexible guide band 5 can be inserted. A spring 29 is arranged between the under surface of said patterning frame 30 and the upper surface of the steel band guiding member 28, so that the bottom edge of said flexible guide band 5 can always touch the upper surface of said working table 1.

A flexible guide band 5 is mounted on a plurality of steel band by inserting it into said vertical slits provided thereon, and the total length of the band 5 is almost equal to the total width of one row of patterning device 20. Thus when the projections of the frames 30 beyond the vertical displaceable frame 22 are adjusted so that each projection is differ from the adjacent one, the flexible band 5 can be deformed to a curved surface. By this adjustment the side surface of the deformed flexible guide band 5 shows a curved surface, which is similar to the curved stitching line on the garment sections. Because the lower edge of said flexible guide band 5 is always in contact with the upper surface of the working table 1 due to said spring 29, said sides of garment sections to be seamed can be arranged on the table 1 so that said sides can be well matched to said curved surface of the flexible guide band 5 when said garment sections are placed correctly on said table 1.

As shown in FIG. 1, a belt driving pulley 6 is mounted on a vertical shaft, which is slidable axially and rotatably mounted on a journal fixed on said frame of the machine. Another three guide pulleys 8, 9 and 10 are mounted on their shafts, which are also slidable axially and rotatably mounted on respective journals fixed on said frame of the seamer.

When the endless flat belt 4 is forcably inserted into the space formed between said plurality of pairs of rollers 33, and also is lowered on the surface of the working table 1, one portion of said belt is situated at the front position, near the sewing needle of the sewing machine head 2, and another portion of said belt extends to the surface of the belt driving pulley 6 via a guide pulley 10, and also reaches the space between the first pair of rollers 33 after being guided by guide pulleys 8 and 9. It is preferable that a tension pulley 7 of larger height than that of said pulleys 8 and 9 be provided so that said belt 4 can be tensioned either at its lowered position or lifted position by said pulley.

A longitudinal shaft 43 is turnably mounted on a frame of said seamer and parallel to the arrangement of said patterning heads 20. A lifting arm 42 is fixed on said longitudinal shaft 43, and by the arrangement of said lifting arm 42 together with the connecting rod 41, the turning motion of said shaft 43 can be converted to the vertical movement of the lifting rods 23. This is because one end of said connecting rod 41 is pivotably mounted on a stud provided on a lifter bar 40 mounted in the square holes of the plurality of lifting rods 23.

The shaft 43 can be turned by means of an air cylinder 46 via a connecting arm 44 fixed on said longitudinal shaft, 43, and a piston rod 45 of said air cylinder 46, so that all of the patterning frames 30 can be lifted simultaneously.

One back side lifting shaft 53 and two lateral lifting shafts 54 and 55 are turned synchronously to said shaft 43 via a combination of a pulley lifting arm 50 fixed on said shaft 43 and a connecting rod 51, and also a combination of a second lifting arm 52 fixed on the back pulley lifting shaft 53, when the turning of the shaft 43 is induced by the air introduced into the cylinder 46 via a solenoid directional control valve (not shown). By the turning of these shafts, 43, 53, 54, 55 the pulleys 6, 8, 9 and 10 are lifted simultaneously away from the level of the working table 1 together with the vertical movement of the patterning frame 30. Such lifting motion is converted from the turning movement of said shafts via two combined mechanisms which consist of two third lifting arms 56 and two arms 59 provided with a pin 58 mounted on a cross bar 60 of two pulley shafts for said pulleys. A motor 13, which drives the endless flat belt 4 via a belt driving pulley 6, and another motor for the sewing machine head 2, are installed on the seamer. A two step type foot lever 15 is provided at the lower portion of the frame of the seamer.

It is preferable to provide an electrical control box, which consists of a main switch, a counter device and other electrical elements.

One of the microswitches 16 is provided on the frame of the seamer, so that it acts on a solenoid directional control valve for feeding the compressed air to cylinder 46, or on a first timer so that it starts the turning of the belt driving motor 13.

In the region near and upstream of the sewing machine head 2, a photo-cell 3 is provided on the working table 1, to detect the front end and also the rear end of the moving cloth to be seamed. When the front end of said cloth is detected by means of said photo-cell 3, said cell acts to start the running of the sewing machine head 2. When the rear end of the cloth is detected by means of the photo-cell 3, said cell actuates the second timer (not shown), and also the third timer (not shown). The second timer acts to stop the movement of the endless flat belt 4 after a given length of time has elasped while the third timer acts to stop the operation of the sewing machine head 2 after a given length of time has elasped, and also to lift the endless belt 4 away from the surface of the working table 1 via the operation of said solenoid directional control valve (not shown).

A discharging and conveying apparatus (not shown) is usually arranged downstream of the sewing machine head 2, so that the clothes already seamed are conveyed on said apparatus and transported to the following machine (not shown) or to a suitable container.

The seaming operations by means of the sutomatic long seamer of the present invention are carried out as follows.

Before the start of the seaming operation for clothes to be seamed, a preparatory adjusting operation is necessary so that the side surface of the flexible guide band 5 is deformed into a curve similar to that of the stitching line on the clothes or garment sections. This adjustment can be accomplished by adjusting the projecting length of the patterning frame 30 beyond the corresponding vertically displaceable frame 22. A rear end portion of the curved flexible band 5 must be a flat surface followed by a curved surface, which is parallel to the longitudinal direction of the frame of the machine. After the completion of this adjustment, said endless flat belt 4 held by the patterning heads 31 has a curve similar to that of the flexible guide band 4. Also said belt 4 is maintained in its lifted position, from the upper surface of the working table 1, by means of the air introduced in the cylinder 46 so that the necessary space is provided to insert said fabrics to be seamed between the lower edge of said belt 4 and the upper surface of said working table 1. When an operator places said clothes on the upper surface of the working table 1. All of the suction holes 11 are covered by said cloth. When the operator then pushes down a foot pedal 15 to the level of a first step, the suction air supplied from the suction source via a suitable valve means is applied to the underside of the fabrics to be seamed. Consequently, said clothes can be firmly held on said upper surface of said working table 1, and in such a state that the curved edges of said clothes or garment sections are in close contact with the curved surface of the flexible guide band 5. When such edges of the clothes and the guide band 5 are not closely in contact, the operator must eliminate such a condition by adjusting the arrangement of the cloth on the working table after releasing the foot lever 15.

When the pedal 15 is moved to the second step, said suction force is cut out by said valve means and, simultaneously, said pedal 15 pushes the microswitch 16. Then said microswitch 16 actuates a magnetic valve, so that compressed air from a compressed air source (not shown) is supplied to the cylinder 46. Therefore, the shaft 43 is turned by the compressed air via a combination of a connecting arm 44 and a piston rod 45 projected from the air cylinder 46. By this turning of the shaft 43 all of the lifting rods 33 of all of the patterning devices 20 are pulled downwardly against the spring forces of all of the springs 24 and, at the same time, the belt driving pulley 6 and three guide pulleys 8, 9 and 10 are simultaneously lowered by the simultaneous rotations of the back pulley lifting shaft 53 and the lateral lifting shafts 54, 55. As a result of the lowering and approaching of the bottom edge of the endless flat belt 4 to the surface of the working table 1, when the belt 4 comes in contact with the upper surface of said fabric, when said belt moves, then said belt moves together with said lied between the belt 4 and the working cloth on the working table 1.

The signal from said microswitch 16 acts to operate the first timer (not shown). Said timer acts to start the turning of the belt driving motor 13 after 0.2 – 0.3 second has elasped. Accordingly, the endless flat belt 4 commences its turning movement and the clothes to be seemed are moved toward the sewing machine head 2 while said cloth slips on the surface of the working table 1.

When photo-cell 3, arranged in the region near but upstream of the sewing machine head 2, detects the front edge of the cloth at a position just above said cell 3, said photo-cell 3 sends a signal to the sewing machine driving motor (not shown), so that said sewing machine head 2 commences its operation. When the clothes to be seemed are moved toward the sewing machine head 2 according to the turning movement of the endless flat belt 4 along its passage, the stitching operation by means of sewing machine head 2 is commenced. Such stitching can be carried out by said sewing machine head 2 along the stitching line of the clothe or garment section.

All portions on the stitching line of the garment section are progressively moved on the same curved line, while said garment section is partially deformed. These deformations will never be troublesome for this operation, because said garment section is flexible.

When the rear end of the cloth already seamed passes said photo-cell 3, said photo-cell 3 sends a signal to the second timer (not shown), so that after about 0.2 – 0.3 second has elasped the belt driving motor 13 stops its turning and, at the same time said signal acts on the third timer (not shown), so that after about 0.5 second has elapsed, the sewing machine motor (not show) stops its running. The solenoid directional control valve (not shown) for changing the supply way of the compressed air to the cylinder 46, the changing operation of which being commenced synchronously with the stopping of the running of said sewing machine, is provided so that the endless flat belt 4 together with the belt driving pulley 6 and the guide pulleys 8, 9 and 10 are lifted upwardly by the air. Consequently when the bottom edge of said belt 4 is separated from the top surface of the working table 1, the cloth already seamed is freed so that said cloth can be conveyed to the following processing station by means of a conveyor (not shown).

As mentioned above, a cloth can be automatically seamed by the sewing machine head along the requested stitching line after the cloth to be seamed is placed on a given position of the upper surface of the working table 1 and the foot lever is pushed down by the operator. These are the only two operator operations necessary during one cycle of this seaming operation.

When the stitching line is severely curved, the patterning heads must be arranged as close together as possible. This is because, the pattern of the flexible guide band has a curve which is exactly matched to the required stitching curved line.

As mentioned above, the long seamer of the present invention occupies a slight longer space than the length of a cloth to be seamed and, therefore, it is about half the length of floor space necessary for the conventional long seamer using a pattern rail. This means that large savings in occupied floor space can be realized. Furthermore, many of the pattern rails used in the conventional long seamer become unnecessary for the long seamer of the present invention. As a result, the adjusting operation necessary for patterning devices can be carried out by the operator with ease.

Figure 5:
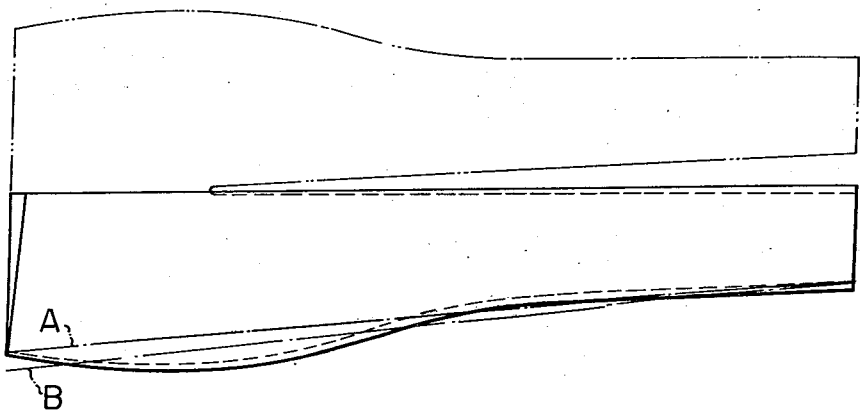
FIG. 5 shows a garment section cut in a given shape from a raw fabric, and also shows a stitching line and a straight line used for setting a curve of the guide band.
Figure 6:
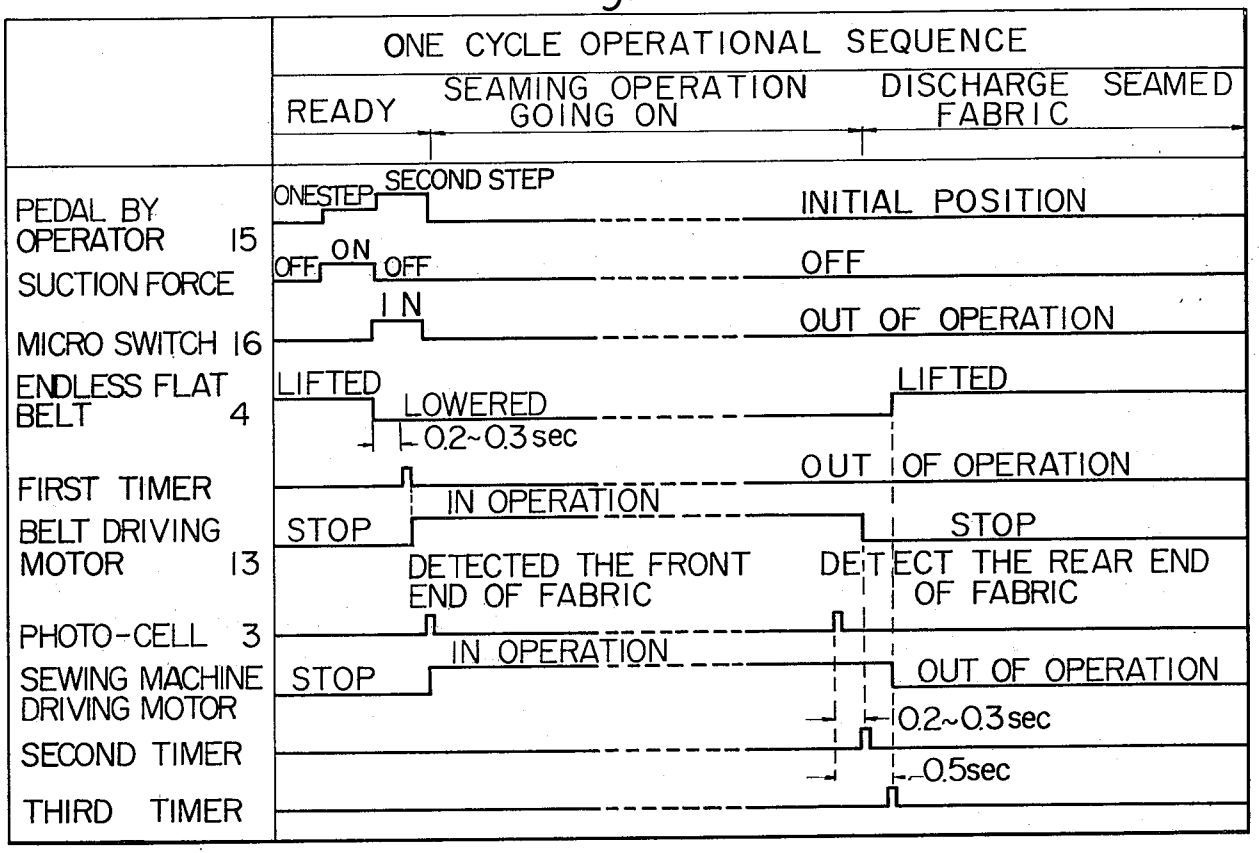
FIG. 6 shows a diagram of the operational sequence of the present automatic long seamer.

In some cases the curved surface of the flexible guide band 5 can be designed so that straight line extending from the sewing machine needle to the separating point, between the endless belt 4 and the guide pulley 9, matches the line A or B shown in FIG. 5.

What is claimed is:

1. An automatic seaming method for seaming fabrics by means of a long seamer comprising a sewing machine head at an end of a working table, a plurality of patterning devices arranged in parallel and upstream from said sewing machine head, an endless and flexible flat member guided by said patterning devices which moves the fabric to be seemed to the sewing machine head characterized by the steps of:

deforming a flexible guide band to a curve by means of said plurality of patterning devices, along which curve seaming is carried out by said sewing machine head;

guiding the endless and flexible flat member by means of corresponding guide devices on said patterning devices along a curved passage similar to the curve of the flexible guide band;

moving clothes to be seamed together with the movement of said endless and flexible flat member along the curved surface of said flexible guide band in such a way that all portions on the stitching line of said clothes or garment sections are moved along the same curved passage;

stitching said clothes by the sewing machine head.

2. An automatic long seamer for carrying out the method as claimed in claim 1, wherein a sewing machine head is arranged at the end of a stationary working table, comprising:

a cloth travelling means, which moves clothes to be seemed toward the sewing machine head according to the movement of an endless and flexible flat member (4) moving within the horizontal plane parallel to the surface of said stationary working table;

an upwardly displacing means for said endless and flexible flat member for lifting said member from the surface of the working table when clothes to be seamed are placed on the working table;

a flexible pattern guide means of a guide surface curved along the curve of the stitching line to be seamed, and;

a flexible member deforming means, which deforms the passage of the endless and flexible flat member, so that said member is moved along a curved passage similar to the guide surface of said flexible pattern guide means.

3. A long seamer as claimed in claim 2, wherein, the cloth travelling means comprises, an endless and flexible flat member, the travelling passage of which is within a horizontal plane, and which is guided by guide members on the patterning devices, and is pressed against the surface of the working table, so that said member moves together with the clothes to be seamed.

4. A long seamer as claimed in claim 2, wherein, the flexible member deforming means comprises a plurality of patterning devices arranged in parallel and spaced equally.

5. A long seamer as claimed in claim 2 wherein, the flexible pattern guide means comprises, a flexible guide band, the curved surface of which is defined by a plurality of patterning devices, and is always in contact with the surface of the working table.

6. A long seamer as claimed in claim 3, wherein the patterning device for deforming the flexible guide band and also the endless and flexible flat member comprises:

a vertically displaceable frame (22), and;

a patterning frame (30), which can be adjustably projected beyond said vertically displaceable frame.

7. A long seamer as claimed in claim 6, wherein the patterning device further comprise:

a plurality of frames mounted on the frame of the long seamer in parallel arrangement;

a guide roller arrangement for guiding said flexible flat member;

a guide roller frame for holding said guide roller arrangement, and;

a vertical lifting mechanism for said guide roller frame.

8. A long seamer as claimed in claim 7, wherein the guide roller arrangement comprises:

a pair of vertical guide rollers, which rotate freely and are held on the guide roller frame in such a condition that the width of the space between the two rollers is slightly narrower than the width of said endless and flexible flat member, and;

an upper guide roller, which rotates freely and is held horizontally on said guide roller frame in such a condition that said roller guides the upper edge of said flexible flat member and also pushes said edge downwardly.

* * * * *